US005118171A

United States Patent [19]

Ortiz

[11] Patent Number: 5,118,171

[45] Date of Patent: Jun. 2, 1992

[54] AWARD DISPLAY CASE

[76] Inventor: Sigifredo Ortiz, 14430 Duncannon, Houston, Tex. 77015

[21] Appl. No.: 663,627

[22] Filed: Mar. 4, 1991

[51] Int. Cl.[5] ..... A47B 88/06

[52] U.S. Cl. ..... 312/114; 312/204

[58] Field of Search ..... 40/154, 155, 152, 160, 40/538; 312/114, 204

[56] References Cited

U.S. PATENT DOCUMENTS

| | | | |
|---|---|---|---|
| 2,402,561 | 6/1946 | Levingston | 40/538 |
| 3,552,052 | 1/1971 | Allen | 40/154 |
| 4,244,303 | 1/1981 | Kurasik | 40/152 |

*Primary Examiner*—Joseph Falk
*Attorney, Agent, or Firm*—Kenneth A. Roddy

[57] ABSTRACT

A display case is disclosed which is particularly useful for mounting and attractively displaying an article of headgear along with memorabilia related to the headgear. The case has generally rectangular box-like frame divided into an upper portion and a lower portion by a shelf member extending transversly between the side walls. A background panel of rigid penetrable material is disposed adjacent the back wall and has fabric material secured thereon to serve as an ornamental background. The fabric material comprises a first section of decorative fabric material, such as a flag, disposed in the frame upper portion to serve as an ornamental background for an article of headgear, and a second section of fabric fastener material disposed in the frame lower portion serves as a mounting surface for awards, medals, and other memorabilia related to the headgear. The material in the lower portion has a soft pile formed of loops to releasably receive and retain the hook element of a hook-and-loop type fabric fastener for securing objects thereon by fabric fastener elements and the penetrable material substrate allows objects having pins, tacks, and other sharp objects to be releasably pinned to the background panel. An article of headgear is secured in the frame upper portion, and articles of memorabilia related to the headgear are secured on the fastener material in the lower portion of the case. A pane of transparent material covers the lower portion of the frame and the articles of memorabilia.

11 Claims, 2 Drawing Sheets

AWARD DISPLAY CASE

BACKGROUND OF THE INVENTION

1. Field of the Invention

This invention relates generally to display cases, and more particularly to an award display case particularly suited for mounting and attractively displaying a piece of headgear along with awards, medals, and other memorabilia related to the headgear.

2. Brief Description of the Prior Art

Distinctive headgear, such as caps and helmets are worn in various occupations, sports, and in the military. Most persons retain the headgear as a memento of fond memories and pride of having spent time in the military service, sport, or occupation. Most persons will also accumulate various awards, medals, banners, ribbons, and other memorabilia representing achievements, or reminders of events which took place during their time in the military service, sport, or occupation.

Some memorabilia such as photos, newspaper clippings, and other flat articles may be preserved in a scrapbook or album. Other small items such as medals, banners, ribbons, and the like may be mounted in a frame and hung on the wall. However, the headgear is usually stored out of sight in a closet or other location because of its size and lack of a convenient display holder or support.

It would therefore be desirable to provide a display case which is particularly suited for mounting and attractively displaying a piece of headgear along with the awards, medals, and other memorabilia which are related to the headgear.

There are several patents which disclose display cases for various articles, but none are particularly suited for mounting and displaying a piece of headgear along with the awards, medals, and other memorabilia, related to the headgear.

Swabado, U.S. Pat. No. 174,358 discloses a wall plaque planter design. Bennett, U.S. Pat. No. 240,365 discloses a team standing display having a series of miniature helmets mounted thereon. Buschmann, U.S. Pat. No. 260,748 discloses an artifact plaque having a medallion. Adler, U.S. Pat. No. 172,325 discloses a combined picture frame and planter box.

Hansson, U.S. Pat. No. 4,811,996 discloses a decorative display and storage case for storing earrings.

McLellan, U.S. Pat. No. 4,879,145 discloses a display case for storing a memorial flag.

The present invention is distinguished over the prior art in general, and these patents in particular by a display case which is particularly useful for mounting and attractively displaying an article of headgear along with memorabilia related to the headgear. The case has generally rectangular box-like frame divided into an upper portion and a lower portion by a shelf member extending transversely between the side walls. A background panel of rigid penetrable material is disposed adjacent the back wall and has fabric material secured thereon to serve as an ornamental background. The fabric material comprises a first section of decorative fabric material, such as a flag, disposed in the frame upper portion to serve as an ornamental background for an article of headgear, and a second section of fabric fastener material disposed in the frame lower portion serves as a mounting surface for awards, medals, and other memorabilia related to the headgear.

The material in the lower portion has a soft pile formed of loops to releasably receive and retain the hook element of a hook-and-loop type fabric fastener for securing objects thereon by fabric fastener elements and the penetrable material substrate allows objects having pins, tacks, and other sharp objects to be releasably pinned to the background panel. An article of headgear is secured in the frame upper portion, and articles of memorabilia related to the headgear are secured on the fastener material in the lower portion of the case. A pane of transparent material covers the lower portion of the frame and the articles of memorabilia.

SUMMARY OF THE INVENTION

It is therefore an object of the present invention to provide an award display case which is particularly useful for mounting and attractively displaying an article of headgear along with memorabilia related to the headgear.

It is another object of this invention to provide an award display case which is divided into an upper portion and a lower portion whereby an article of headgear may be secured in the upper portion and memorabilia related to the headgear may be secured in the lower portion.

Another object of this invention is to provide an award display case which has background panel of rigid penetrable material adjacent the back wall covered with decorative material to serve as an ornamental background.

Another object of this invention is to provide an award display case which has background panel of rigid penetrable material covered with an upper section of decorative fabric material to serve as an ornamental background for an article of headgear, and a lower section of fabric fastener material to serve as a mounting surface for awards, medals, and other memorabilia related to the headgear.

Another object of this invention is to provide an award display case which has a background panel formed of material having a soft pile formed of loops to releasably receive and retain the hook element of a hook-and-loop type fabric fastener for securing objects thereon by fabric fastener elements and which has a penetrable material substrate allowing objects having pins, tacks, and other sharp objects to be releasably pinned to the background panel.

A further object of this invention is to provide an award display case whereby an article of headgear is secured in an upper portion and articles of memorabilia related to the headgear are secured in a lower portion an a pane of transparent material covers the lower portion of the frame and the articles of memorabilia.

A still further object of this invention is to provide an award display case which simple in construction, economical to manufacture, and aesthetically pleasing.

Other objects of the invention will become apparent from time to time throughout the specification and claims as hereinafter related.

The above noted objects and other objects of the invention are accomplished by the present display case which is particularly useful for mounting and attractively displaying an article of headgear along with memorabilia related to the headgear. The case has generally rectangular box-like frame divided into an upper portion and a lower portion by a shelf member extending transversely between the side walls. A background panel of rigid penetrable material is disposed adjacent the back wall and has fabric material secured thereon to serve as an ornamental background. The fabric material comprises a first section of decorative fabric material, such as a flag, disposed in the frame upper portion to serve as an ornamental background for an article of headgear, and a second section of fabric fastener material disposed in the frame lower portion serves as a mounting surface for awards, medals, and other memorabilia related to the headgear. The material in the lower portion has a soft pile formed of loops to releasably receive and retain the hook element of a hook-and-loop type fabric fastener for securing objects thereon by fabric fastener elements and the penetrable material substrate allows objects having pins, tacks, and other sharp objects to be releasably pinned to the background panel. An article of headgear is secured in the frame upper portion, and articles of memorabilia related to the headgear are secured on the fastener material in the lower portion of the case. A pane of transparent material covers the lower portion of the frame and the articles of memorabilia.

DESCRIPTION OF THE PREFERRED EMBODIMENT

Figure 1:
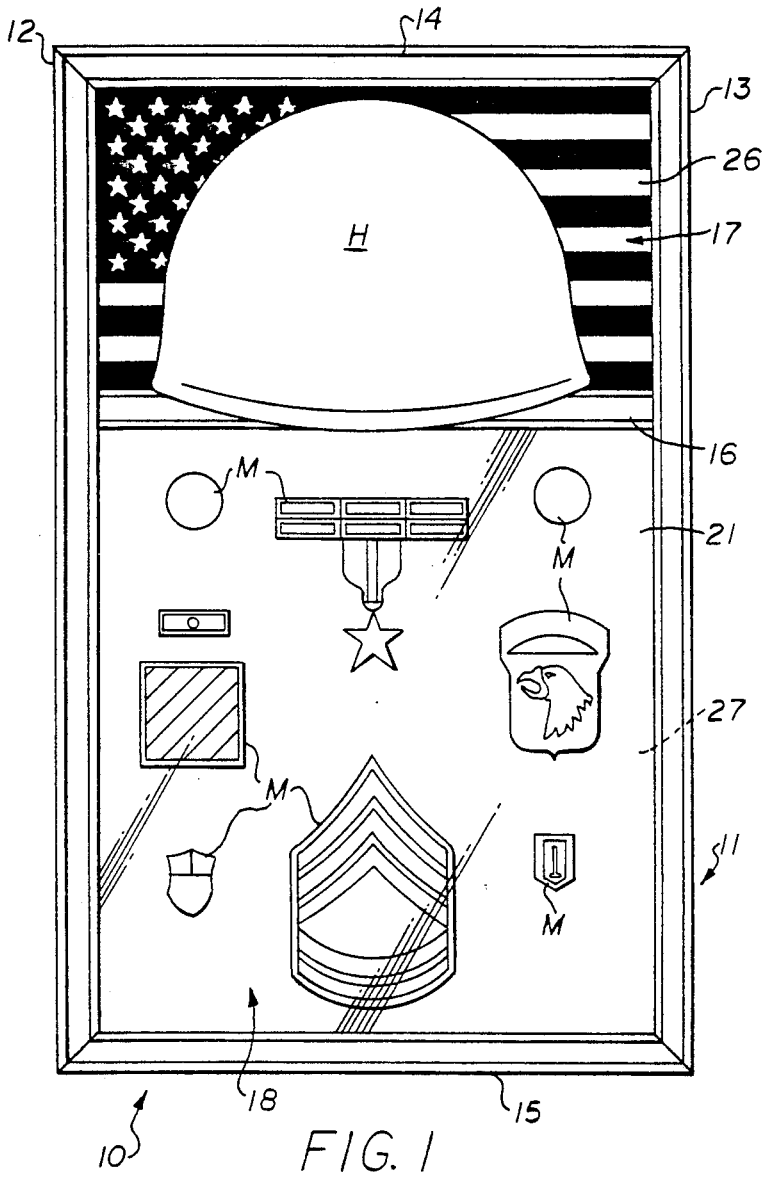
FIG. 1 is a front elevation of the award display case in accordance with the present invention shown assembled with a military helmet in the upper portion and awards, medals, and other memorabilia, related to the helmet in the lower portion.
Figure 2:
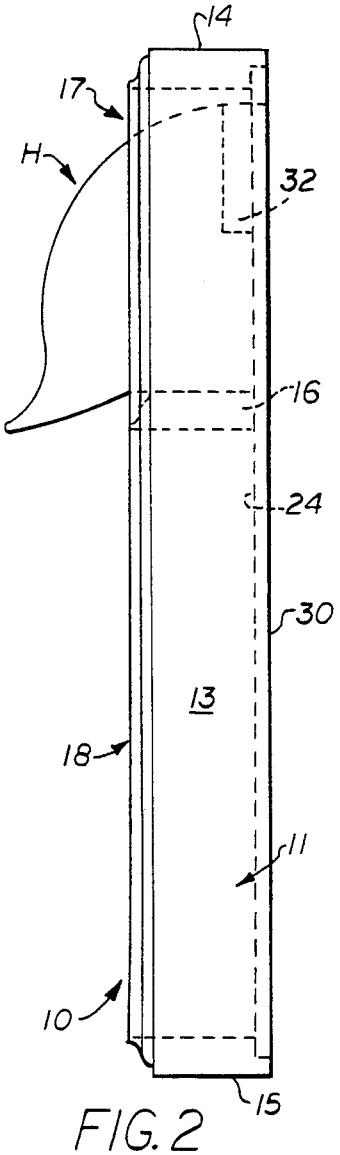
FIG. 2 is a side elevation view of the display case of FIG. 1.

Referring to the drawings by numerals of reference, there is shown in FIGS. 1 and 2, a preferred award display case 10 in its assembled condition and containing a piece of headgear H, in the form of a military helmet in the upper portion and several awards, medals, and other memorabilia M related to the helmet in the lower portion.

Figure 3:
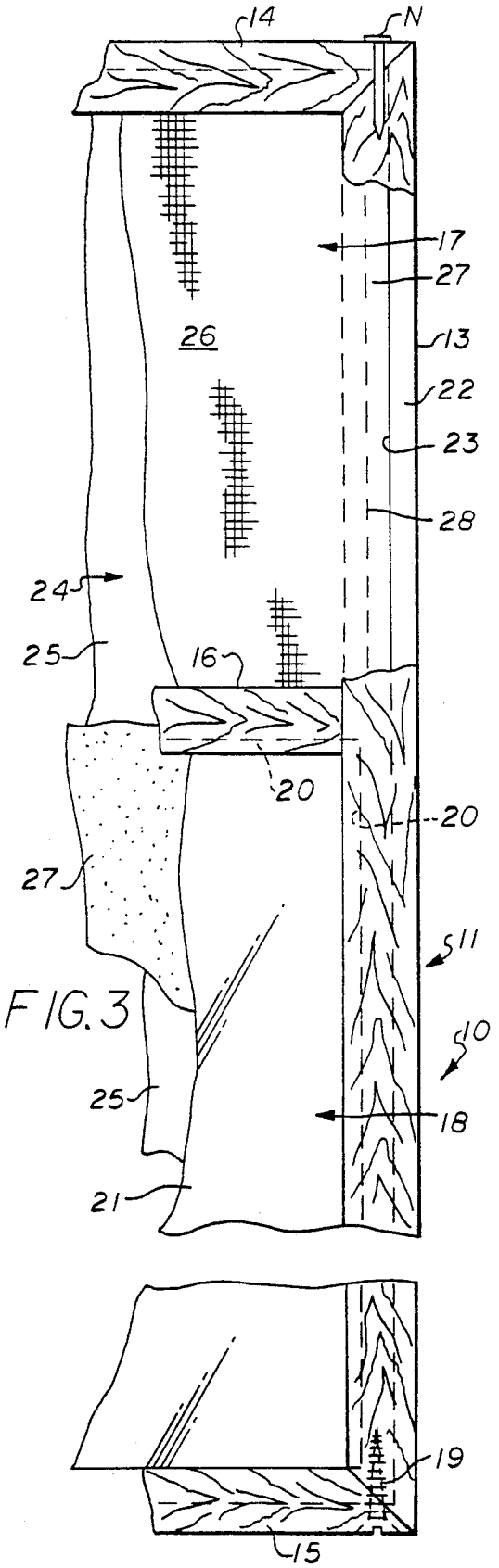
FIG. 3 is a front elevation of one side of the display case in partial cross section.
Figure 4:
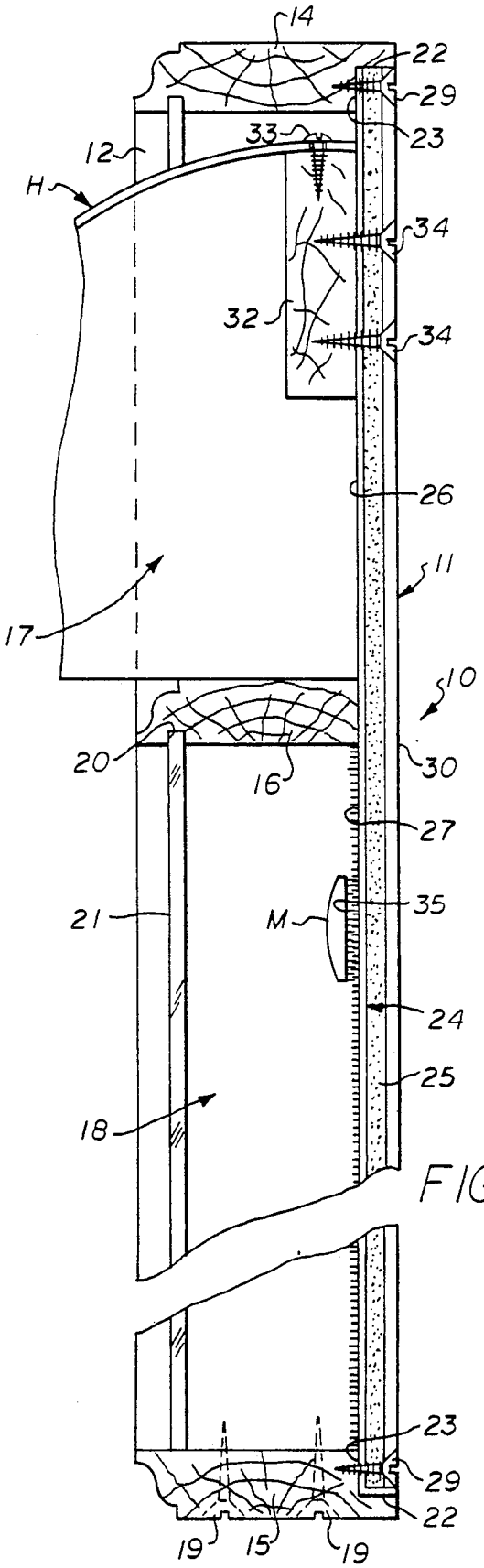
FIG. 4 is a longitudinal cross section of the display case.

Referring additionally to FIGS. 3 and 4, the display case 10 has box-like frame 11 preferably constructed of wood. The frame 11 has opposed vertical side walls 12 and 13, a top wall 14, a bottom wall 15, and a divider piece or shelf member 16. The walls 12–15 and shelf piece 16 are flat rectangular pieces. The outer facing edge profile of each wall may be ornamentally contoured.

The two vertical side walls 12 and 13, the top wall 14, and the divider or shelf member 16 are joined together with carpenter's glue and finish nails N to form a rectangular box-like configuration. The divider or shelf member 16 extends horizontally between the side walls 12 and 13, and is spaced a distance below and parallel to the top wall 14. The shelf member 16 is preferably positioned to divide the case 10 into a top portion 17 occupying approximately one-third of the frame 11 and a bottom portion 18 comprising the remaining two-thirds of the frame.

The bottom wall 15 extends horizontally between the bottom ends of the two side walls 12 and 13, but is removably connected thereto by wood screws 19.

As seen in cross section in FIG. 4, the inwardly facing surfaces of the side walls 12 and 13, the top wall 14, and the underside of the shelf member 16 are provided with a longitudinally extending groove 20 to slidably receive a pane of glass 21, as explained hereinafter.

The rear end surfaces of the side walls 12 and 13, the top wall 14 and the bottom wall 15 are rabbeted at 22 near their outer edges to form a rectangular recess 23 inwardly from their outer sides as seen in FIGS. 3 and 4 when the walls are assembled together. The width of the shelf member 16 is approximately the same dimension as the width of the top and bottom wall members 14 and 15 less the rabbeted portion, such that the rear end of the shelf member 16 is flush with the recessed portion 23.

A flat rectangular background panel 24, constructed of a substrate panel 25 of rigid penetrable material having a decorative fabric outer covering is installed in the display case 10. A preferred substrate panel material is a rigid plastic foam known as "Fome-Core", cork material, or other suitable material which may be penetrated by pins.

The upper portion of the outer surface of the substrate panel 25 is covered with a decorative fabric material 26, such as a flag, as shown the example of FIG. 1, and the lower portion of the substrate panel 25 is covered by a fabric material 27 having a thick soft pile formed of loops of sufficient density to releasably receive and retain the hook element of a hook-and-loop type fabric fastener, such as Velcro (tm). A preferred fabric of this type is known as "Velvet Loop" (tm).

In a preferred embodiment, the decorative material 26 (flag) occupies the upper approximate one-third of the background panel and the loop material 27 ("Velvet Loop") occupies the lower two-thirds of the background panel 24. The flag or decorative material and the "Velvet Loop" material are secured to the penetrable substrate panel 24 by adhesive or other suitable means and may be further secured to the substrate panel by staples 28 near the outer edges.

The penetrable substrate material 2 ("Fome-Core") will accept pins, tacks, and other sharp objects used for securing types of memorabilia M having pins. The loop material 27 ("Velvet Loop") is commercially available in a variety of colors and has a texture which will enable objects to be secured thereon by Velcro fastener elements. After the fabric covering materials 26 and 27 have been secured to the substrate material 25, the background panel 24 is placed in the recess 23 of the top wall 14 and side walls 12, 13 and secured therein by staples or screws 29.

A rigid flat rectangular back panel 30, preferably of wood, having substantially the same dimensions of the substrate panel 25, is received in the recess 23 of the walls 12–14 to form the rear wall of the frame 11 and is secured therein by gluing, stapling, nailing, or screws 31.

If the selected headgear H is made of rigid material, such as plastic, or metal, like the military helmet example, it is cut in half. Rigid headgear H may be cut in half from front to back to form a left or right facing half, or it may be cut from side to side to form a forward facing half. Flexible headgear, such as a baseball cap may be folded with the back portion collapsed inward to form a forward facing half, or it may also be cut from front to back to form a left or right facing half.

A semi-cylindrical, disc-like holding block 32, formed of wood is contoured to conform to the interior shape of the selected headgear half H. The headgear half H is secured to the holding block 32. Rigid headgear may be provided with spaced holes near the cut and secured to the holding block 32 with screws 33. Flexible headgear, such as the baseball cap example, may be folded with the back portion collapsed inward to form a forward facing half and secured to the holding block by staples near the fold.

In the military helmet example, the helmet may be covered with camouflage material or may be chrome plated or gold plated to enhance the aesthetics.

After the headgear H has been secured to the holding block 32, the holding block is secured to the background panel 24. Adhesive material is applied to the back surface of the holding block 32, the holding block is positioned above the shelf member 16 with the bottom surface of the headgear H resting on the shelf member, and the holding block is pressed against the upper portion decorative fabric material 26. The holding block 32 is then secured to the background panel 24 by nails or wood screws 34 extending through the back panel 30 and background panel 24. Preferably, a small portion of the headgear extends outward from the shelf member 16, as seen in FIG. 2.

After the background panel 24 has been secured inside the display case 10 and the back panel 30 installed, the memorabilia M, such as medals, ribbons, buttons, badges, insignias, and other small awards are secured to the lower portion of the background panel 24 in an attractive arrangement. Objects having a pin may be stuck into the background panel, or with patches, ribbons, etc., a small piece of Velcro fastener material 35 may be applied to the backside of the object and pressed onto the loop material 27.

When the desired arrangement of awards and memorabilia has been completed, a clear pane of glass 21, or transparent plastic is slid into the grooves 20 on the side walls 12, 13 and its top edge is received in the groove on the underside of the shelf member 16. The bottom wall 15 is then placed at the bottom ends of the side walls 12 and 13 with its top surface engaged on the bottom end of the glass pane 21 and secured to the bottom ends of the walls by screws 19 to secure the glass pane on the front of the lower portion 18 of the display case 10.

Figure 5:
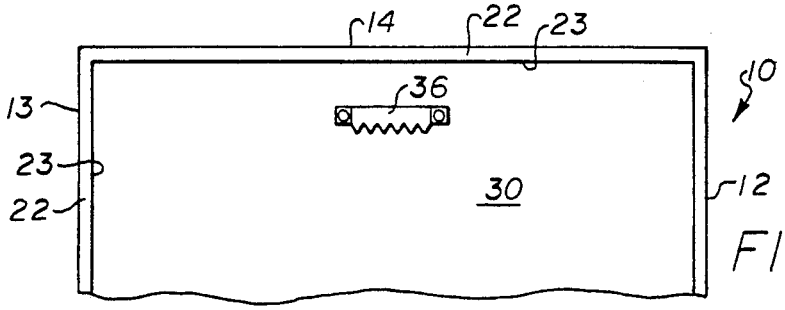
FIG. 5 is a rear elevation of the display case showing a mounting bracket for mounting the display case on a wall.

As seen in FIG. 5, a mounting bracket 35 may be secured to the back side of the back panel 30 for mounting the display case 10 on a wall. When it is desired to add or change the memorabilia M inside the case, the bottom wall 15 is removed by taking out the screws 19 and the glass pane 21 is slid out of the bottom of the frame 11.

While this invention has been described fully and completely with special emphasis upon a preferred embodiment, it should be understood that within the scope of the appended claims the invention may be practiced otherwise than as specifically described herein.

I claim:

1. A display case for mounting and attractively displaying an article of headgear along with awards, medals, and other memorabilia related to the headgear comprising:

a generally rectangular box-like frame having a back wall, a top wall, a bottom wall, and a air of opposed side walls, a shelf member extending transversely between said side walls and dividing said frame into an upper portion and a lower portion, a background panel disposed in said frame upper portion and said lower portion adjacent said back wall and having decorative fabric material on one side to serve as an ornamental background, and headgear mounting means secured to said back wall in said frame upper portion for receiving and mounting an article of headgear thereon, said decorative material comprising a first section of decorative fabric material disposed in said frame upper portion to serve as an ornamental background for said article of headgear, and a second section of fabric fastener material disposed in said frame lower portion to serve as a mounting surface for awards, medals, and the like related to the headgear.

2. A display case according to claim 1 wherein said background panel is formed of a generally rectangular sheet of rigid penetrable material.

3. A display case according to claim 1 wherein said second section of fabric material has a thick soft pile formed of loops of sufficient density to releasably receive and retain the hook element of a hook-and-loop type fabric fastener for securing objects thereon by fabric fastener elements.

4. A display case according to claim 1 wherein said background panel is formed of a generally rectangular sheet of rigid penetrable material, said first section of said decorative fabric material and said second section of said fabric fastener material being secured to said sheet of rigid penetrable material to cover the outer surface thereof, whereby said second section of said fabric fastener material will allow objects to be secured to said background panel by mating fabric fastener elements and said rigid penetrable material will allow objects having pins, tacks, and other sharp objects to be releasably pinned to said background panel.

5. A display case according to claim 4 wherein the rear edges of said side walls, said top wall, and said bottom wall are rabbeted to form a generally rectangular recess extending around the inner periphery of said frame, and said background panel and said back wall are secured within said generally rectangular recess.

6. A display case according to claim 1 wherein said shelf member is positioned to divide said frame into a top portion occupying approximately one-third of the case and a bottom portion comprising the remaining two-thirds of the case.

7. A display case according to claim 1 wherein the inwardly facing surfaces of side walls and the underside of said shelf member are provided with a longitudinal groove, and including a pane of transparent material slidably received in said grooves to provide a transparent cover which covers said frame lower portion.

8. A display case according to claim 7 wherein said bottom wall is removably connected to said side walls at the bottom ends thereof, and said pane of transparent material may be slidably removed from said frame lower portion after said bottom wall is removed.

9. A display case according to claim 1 including an article of headgear secured on said headgear mounting means to occupy said frame upper portion in front of said decorative fabric material, and memorabilia related to said article of headgear secured to said decorative fabric material to occupy said frame lower portion.

10. A display case for mounting and attractively displaying a piece of headgear along with awards, medals, and other memorabilia related to the headgear comprising;

a generally rectangular frame having a back wall, a top wall, a bottom wall, and a pair of opposed side walls, a shelf member extending transversely between said side walls and dividing said frame into an upper portion and a lower portion, a background panel disposed in said frame upper portion and said lower portion adjacent said back wall and having decorative fabric material on one side to serve as an ornamental background, an article of headgear secured in said frame upper portion, articles of memorabilia related to said article of headgear secured to said decorative fabric material to occupy said frame lower portion, and a pane of transparent material secured on said frame to provide a transparent cover over said lower portion and the articles of memorabilia.

11. A display case according to claim 10 in which said article of headgear comprises a helmet, and said articles of memorabilia are articles selected from the group comprising ribbons, buttons, badges, insignias, and other small awards related to said helmet.

* * * * *